US012031532B2

(12) United States Patent
Mo et al.

(10) Patent No.: US 12,031,532 B2
(45) Date of Patent: Jul. 9, 2024

(54) COMPRESSOR HEAD FIXING DEVICE, COMPRESSOR AND REFRIGERATION DEVICE

(71) Applicant: GREE GREEN REFRIGERATION TECHNOLOGY CENTER CO., LTD. OF ZHUHAI, Guangdong (CN)

(72) Inventors: Ziyang Mo, Zhuhai (CN); Juanjuan Chen, Zhuhai (CN); Min Xu, Zhuhai (CN); Yaozong Yan, Zhuhai (CN); Chuanshun Huang, Zhuhai (CN)

(73) Assignee: GREE GREEN REFRIGERATION TECHNOLOGY CENTER CO. LTD. OF ZHUHAI, Guangdong (CN)

( * ) Notice: Subject to any disclaimer, the term of this patent is extended or adjusted under 35 U.S.C. 154(b) by 509 days.

(21) Appl. No.: 17/285,448

(22) PCT Filed: Sep. 2, 2019

(86) PCT No.: PCT/CN2019/103967
§ 371 (c)(1),
(2) Date: Apr. 14, 2021

(87) PCT Pub. No.: WO2020/119190
PCT Pub. Date: Jun. 18, 2020

(65) Prior Publication Data

US 2021/0340966 A1 Nov. 4, 2021

(30) Foreign Application Priority Data

Dec. 11, 2018 (CN) ..... 201811512032.4

(51) Int. Cl.
*F04B 39/00* (2006.01)
*F04B 39/10* (2006.01)
*F04B 39/12* (2006.01)

(52) U.S. Cl.
CPC ..... *F04B 39/0083* (2013.01); *F04B 39/0055* (2013.01); *F04B 39/0066* (2013.01); *F04B 39/122* (2013.01); *F04B 39/1073* (2013.01)

(58) Field of Classification Search
CPC ..... F04B 39/0083; F04B 39/0055; F04B 39/122; F04B 39/1073; F04B 39/125; F04B 39/0066; F04B 39/03; F04B 39/123
(Continued)

(56) References Cited

U.S. PATENT DOCUMENTS 6,305,912 B1 10/2001 Svendsen et al.
6,547,536 B2 * 4/2003 Seo ..... F04B 39/0061 417/415
9,518,680 B2 * 12/2016 Lee ..... F04B 39/1073

FOREIGN PATENT DOCUMENTS

CN 104696194 A 6/2015
CN 106762551 A 5/2017
(Continued)

OTHER PUBLICATIONS

Machine Translation of KR-0143141-B1 (Year: 1998).*
Extended European Search Report for European Patent Application No. 19896207.8 dated Sep. 20, 2021 (6 pages).

*Primary Examiner* — Dedei K Hammond
*Assistant Examiner* — Jennifer B. Olson
(74) *Attorney, Agent, or Firm* — J. Miguel Hernandez; James R. Gourley; Carstens, Allen & Gourley, LLP

(57) ABSTRACT

Compressor head fixing device, a compressor and a refrigeration device. The compressor head fixing device includes a cylinder block and a cylinder head cover, the cylinder head cover being connected to the cylinder block by a fastener, the cylinder block being provided with a compression chamber and an assembly hole configured to fix the fastener; a noise reduction chamber, provided on the cylinder block; and a communication passage, provided in the cylinder
(Continued)

block and the cylinder head cover, and being in communication with the assembly hole, the noise reduction chamber and the compression chamber. The compressor head fixing device has a compact structure, a length of the exhaust passage is shortened and the exhaust pressure is reduced.

12 Claims, 3 Drawing Sheets

(58) Field of Classification Search
USPC ..... 181/212
See application file for complete search history.

(56) References Cited

FOREIGN PATENT DOCUMENTS

| | | | | |
|---|---|---|---|---|
| CN | 107701401 | A | 2/2018 | |
| CN | 106870327 | B | 9/2018 | |
| CN | 109653994 | A | 4/2019 | |
| EP | 3039292 | B1 | 11/2017 | |
| KR | 0143141 | B1 * | 8/1998 | |
| WO | 2012148180 | A2 | 11/2012 | |
| WO | WO-2015028075 | A1 * | 3/2015 | ..... F04B 39/0061 |
| WO | WO-2017174501 | A1 * | 10/2017 | |

* cited by examiner

COMPRESSOR HEAD FIXING DEVICE, COMPRESSOR AND REFRIGERATION DEVICE

CROSS REFERENCE TO RELATED APPLICATION

The present application is based on and claims priority to Chinese Patent Application No. 201811512032.4, filed on Dec. 11, 2018, the content of which is expressly incorporated herein by reference in its entirety. This application is a U.S. national phase of International Application No. PCT/CN2019/103967, entitled "Compressor Head Fixing Device, Compressor and Refrigeration Device" filed on Sep. 2, 2019, published as WO 2020/119190 A1 on Jun. 18, 2020. Every patent application and publication listed in this paragraph is hereby incorporated by reference in its entirety.

TECHNICAL FIELD

The present disclosure relates to a compressor head fixing device, a compressor and a refrigeration device.

BACKGROUND

As people's pursuit of a better life has become a major social contradiction, the requirements for space occupation, energy saving and noise reduction of home appliances become higher. With the development of home appliances, the home appliances compressors are becoming smaller, more efficient, and less noise. The refrigerator compressor has characteristics such as miniaturization, low-voltage startup capacity and low noise, which have obvious competitive advantages in market and good user experience.

In the related art, the structures of a cylinder block and a cylinder head cover of a fully enclosed reciprocating compressor is various in forms. The inventors found that the structures of the cylinder block and cylinder head cover of the fully enclosed reciprocating compressor in the related art has the following limitations and problems: (1) the overall size of the cylinder block and the layout size of the cylinder head cover are larger; (2) an exhaust silencing chamber on the cylinder block has a long and narrow exhaust passage; (3) due to the requirements and characteristics of the casting process, the exhaust silencing chamber formed by the casting process in the cylinder block has large structure, thick sidewall of the silencing chamber, and heavy weight.

SUMMARY

In view of this, the present disclosure provides a compressor head fixing device, a compressor and a refrigeration device, in order to solve the above technical problems in the related art.

In one aspect of the present disclosure, a compressor head fixing device is provided, including:

- a cylinder block and a cylinder head cover, the cylinder head cover being connected to the cylinder block by a fastener, the cylinder block being provided with a compression chamber and an assembly hole configured to fix the fastener;
- a noise reduction chamber, provided on the cylinder block; and
- a communication passage, provided in the cylinder block and the cylinder head cover, and being in communication with the assembly hole, the noise reduction chamber and the compression chamber.

In some embodiments, the communication passage includes:

- a first communication section, provided in the cylinder head cover and being in communication with a chamber opening of the compression chamber and an inlet of the assembly hole;
- a second communication section, provided in the cylinder block and being in communication with the assembly hole and the noise reduction chamber; and
- a third communication section, provided in the assembly hole and being in communication with the first communication section and the second communication section.

In some embodiments, the assembly hole includes a fixing portion and a communication portion, the fixing portion cooperates with the fastener to connect the cylinder head cover to the cylinder block, and a gap as the third communication section is formed between the communication portion and the fastener.

In some embodiments, the fastener includes a bolt, a screw rod of the bolt is provided with an external thread, the fixing portion includes an internal thread matching the external thread, the communication portion includes an unthreaded hole, and a radial gap between the unthreaded hole and the screw rod of the bolt forms the third communication section.

In some embodiments, the compressor head fixing device further includes a valve disc and a valve plate, the valve disc is provided between the cylinder block and the cylinder head cover, the valve plate is provided between the valve disc and the cylinder head cover, the valve plate is provided with an air inlet, the valve disc includes a substrate and a first elastic piece, the substrate is provided with a first through hole matching an outer contour of the first elastic piece, the first elastic piece is located in the first through hole, a root of the first elastic piece is connected to a hole wall of the through hole or the root and the hole wall are formed in one piece, the first elastic piece is further provided with a free end which is in the first through hole and is capable of moving away from the valve plate with respect to the substrate, an orthographic projection of the free end of the first elastic piece on the valve plate at least partially overlaps the air inlet.

In some embodiments, the valve disc is provided with a first exhaust port, the valve plate is provided with a second exhaust port, the second exhaust port is in communication with the compression chamber through the first exhaust port.

In some embodiments, the first exhaust port is located at a position on the first elastic piece adjacent to the root of the first elastic piece, an orthographic projection of the first exhaust port on the valve plate at least partially overlaps the second exhaust port.

In some embodiments, the valve disc further includes: a second through hole and a second elastic piece, the valve plate further comprises: a third through hole and an avoidance portion penetrating in a direction perpendicular to the valve plate, the fastener passes through the second through hole and the third through hole to connect to the cylinder block, a hole wall of the second through hole comprises a free end of the second elastic piece, the avoidance portion is in communication with the third through hole in a radial direction, the second elastic piece is capable of moving away from the avoidance portion to make the first communication section be in communication with the third communication section via the avoidance portion.

In some embodiments, the cylinder block includes two assembly holes, one of the two assembly holes is in communication with the noise reduction chamber through the second communication section, the other is an internally closed blind hole, the blind hole is in communication with a chamber opening of the compression chamber through the first communication section to serve as a resonant chamber.

In some embodiments, the cylinder block includes two assembly holes and two noise reduction chambers, the two assembly holes are respectively in communication with the two noise reduction chambers through the second communication section.

In some embodiments, each assembly hole is a stepped hole and comprises a fixing portion with an internal thread and a communication portion with a diameter greater than a diameter of the fixing portion, a gap is provided between the communication portion and the fastener; the gap between the communication portion and the fastener, and the noise reduction chamber respectively form a first silencing chamber and a second silencing chamber, wherein the communication portion is in the assembly hole which is in communication with the noise reduction chamber.

In one aspect of the present disclosure, a compressor head fixing device is provided, including: a cylinder block and a cylinder head cover, the cylinder head cover is connected to the cylinder block by a fastener, the cylinder block is provided with a compression chamber and an assembly hole configured to fix the fastener; a noise reduction chamber, provided on the cylinder block; a communication passage, provided in the cylinder block and the cylinder head cover, and being in communication with the assembly hole, the noise reduction chamber and compression chamber.

In some embodiments, the communication passage includes a first communication section, a second communication section, and a third communication section, the first communication section is provided on the cylinder head cover to communicate with an outlet of the compression chamber and an inlet of the assembly hole, the second communication section is provided on the cylinder block to communicate with the assembly hole and the noise reduction chamber, and the third communication section is provided in the assembly hole to communicate with the first communication section and the second communication section.

In some embodiments, the assembly hole includes a fixing portion and a communication portion, the fixing portion cooperates with the fastener to connect the cylinder head cover to the cylinder block, and a gap is formed between the communication portion and the fastener to form the third communication section.

In some embodiments, the fastener is a screw, the screw is provided with an external thread, the fixing portion is provided with an internal thread matching the external thread, the communication portion is an unthreaded hole, and a gap between the unthreaded hole and the screw forms the third communication section.

In some embodiments, the compressor head fixing device further includes a valve disc and a valve plate, the valve disc is provided between the cylinder block and the cylinder head cover, the valve plate is provided between the valve disc and the cylinder head cover, the valve plate is provided with an air inlet, the valve disc includes a substrate and a first elastic piece, a root of the first elastic piece is provided on the substrate, and an end of the first elastic piece is movably provided at a position corresponding to the air inlet.

In some embodiments, a first exhaust port is provided on the valve disc, a second exhaust port is provided on the valve plate, and the second exhaust port is in communication with the compression chamber through the first exhaust port.

In some embodiments, the first exhaust port is provided at the root of the first elastic piece, and the second exhaust port is provided at a position on the valve plate corresponding to the first exhaust port.

In some embodiments, the valve disc further includes a second elastic piece, the valve plate is further provided with an avoidance portion which is in communication with the first communication section and the third communication section, a position of the second elastic piece corresponds to the avoidance portion.

In some embodiments, the noise reduction chamber is provided with an inlet and an outlet spaced apart to form a silencing chamber, the inlet is connected to the second communication section, and the outlet is connected to a downstream device.

In some embodiments, the noise reduction chamber is only provided with one opening to form a resonant chamber, and the opening is connected to the second communication section.

In some embodiments, an axis of the compression chamber, an axis of the assembly hole, and an axis of the communication passage are coplanar.

In another aspect of the present disclosure, a compressor is provided, including the above-mentioned compressor head fixing device.

In another aspect of the present disclosure, a refrigeration device is provided, including the above-mentioned compressor.

According to the embodiments of the present disclosure, the noise reduction chamber is provided on the cylinder block, and the communication passage is provided in the cylinder block and the cylinder head cover, and is in communication with the assembly hole, the noise reduction chamber and the compression chamber, so that the compressed gas in the compression chamber can be guided through the assembly hole and the communication passage into the noise reduction chamber to achieve noise reduction. In such a way, the communication passage for communicating the noise reduction chamber and the compression chamber is integrated with the assembly hole fixing the fastener, so that the compressor head fixing device has a compact structure, and provides possibility of reducing the volume of the compressor head fixing device, shortening the length of the exhaust passage, and reducing the exhaust pressure.

BRIEF DESCRIPTION OF THE DRAWINGS

The accompanying drawings of the specification constituting a part of the present disclosure are utilized to provide further understanding of the present disclosure, and the exemplary embodiments and descriptions thereof are utilized to explain the present disclosure, and do not constitute an improper limitation on the present disclosure. In the drawings.

Figure 1:
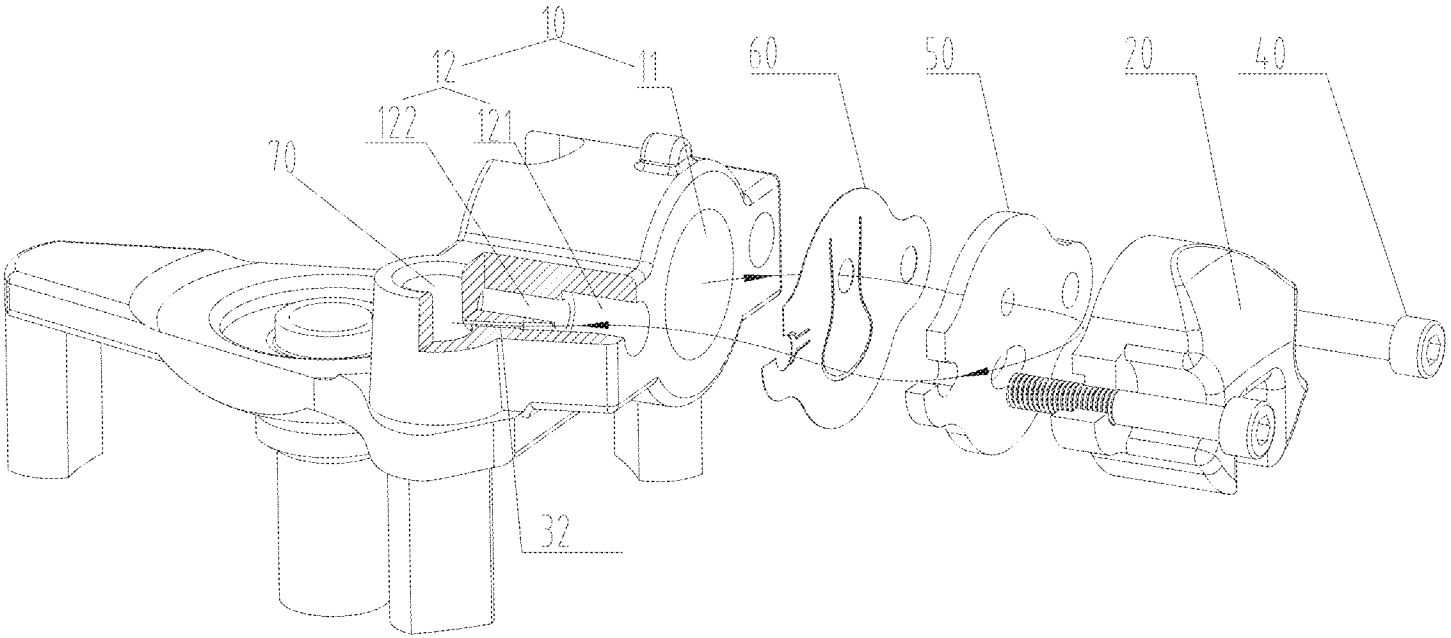
FIG. 1 is a schematic diagram illustrating a decomposed structure of a compressor head fixing device according to some embodiments of the present disclosure.

The above-mentioned drawings include the following reference signs:

10, cylinder block; 11, compression chamber; 12, assembly hole; 121, communication portion; 122, fixing portion; 20, cylinder head cover; 21, cover body; 22, matching notch; 23, guide rib; 24, assembly hole; 25, assembly hole; 31, first communication section; 32, second communication section; 40, fastener; 50, valve plate; 51, air inlet; 52, second exhaust port; 53, base body; 54, assembly hole; 55, assembly hole; 56, avoidance portion; 60, valve disc; 61, substrate; 62, first elastic piece; 63, first exhaust port; 64, assembly hole; 65, assembly hole; 66, second elastic piece; 70, noise reduction chamber.

DETAILED DESCRIPTION

Various exemplary embodiments of the present disclosure will be described in detail with reference to the accompanying drawings. The description of the exemplary embodiments is merely illustrative, and in no way serves as any limitation to the present disclosure and applications or use thereof. The present disclosure can be implemented in many different ways and is not limited to the embodiments described herein. These embodiments are provided to make the present disclosure thorough and complete, and to fully express the scope of the present disclosure to those skilled in the art. It should be noted that unless specifically stated otherwise, relative arrangements of components and steps, material components, numeric expressions and numerical values set forth in these embodiments should be interpreted as merely exemplary rather than limiting.

The wording "first", "second" and other similar wording used in the present disclosure do not indicate any order, quantity or importance, but are only utilized to distinguish different parts. Similar wording such as "comprise" or "include" means that the element before the wording covers the elements listed after the wording, and does not exclude the possibility of covering other elements. The wording "up", "down", "left", "right", etc., are merely utilized to indicate the relative position relationship. When the absolute position of the described object changes, the relative position relationship may also change accordingly.

In the present disclosure, when a specific device is described to locate between a first device and a second device, there may or may not be an intermediate device between the specific device and the first device or the second device. When a specific device is described to connect to another device, the specific device may be directly connected to the other device without an intermediate device, or may not be directly connected to the other device but with an intermediate device.

All terms (including technical terms or scientific terms) used in the present disclosure have the same meaning as understood by those of ordinary skill in the art to which the present disclosure belongs, unless specifically defined otherwise. It should also be understood that terms such as those defined in general-purpose dictionaries should be interpreted as having meanings consistent with their meanings in the context of related technologies, and should not be interpreted in idealized or extremely formalized meanings, unless explicitly defined here.

As for the technologies, methods, and devices known to those of ordinary skill in the relevant fields may not be discussed in detail, but where appropriate, the technologies, methods, and devices should be regarded as a part of the specification of the present disclosure.

As shown in FIG. 1, a compressor head fixing device in this embodiment includes a cylinder block 10, a cylinder head cover 20, a noise reduction chamber 70 and a communication passage. The cylinder head cover 20 is connected to the cylinder block 10 through a fastener 40, and the cylinder block 10 has a compression chamber 11 and an assembly hole 12 configured to fix the fastener 40. The noise reduction chamber 70 is provided on the cylinder block 10, and the communication passage is provided in the cylinder block 10 and the cylinder head cover 20, and is in communication with the assembly hole 12, the noise reduction chamber 70 and the compression chamber 11.

In the technical solution of this embodiment, the noise reduction chamber 70 is provided on the cylinder block 10; the communication passage is provided in the cylinder block 10 and the cylinder head cover 20 and is in communication with the assembly hole 12, the noise reduction chamber 70 and the compression chamber 11, so that a compressed gas in the compression chamber 11 is guided into the noise reduction chamber 70 through the assembly hole 12 and the communication passage to achieve the noise reduction. In such a way, the communication passage for connecting the noise reduction chamber 70 and the compression chamber 11 is integrated with the assembly hole 12 configured to fix the fastener, such that the structure of the compressor head fixing device is compact, and it is possible reduce a volume of the compressor head fixing device and shorten a length of the exhaust passage and reduce the exhaust pressure.

As shown in FIG. 1, in some embodiments, since the communication passage and the assembly hole 12 are integrated and share a part of the space, the cylinder block 10 in this embodiment is assembled with the cylinder head cover 20 by only providing fasteners 40 on both sides of the compression chamber 11, that is, only two fasteners 40 are utilized to connect and fix the cylinder block 10 and the cylinder head cover 20. In some embodiments, an axis of the compression chamber 11, an axis of the assembly hole 12, and an axis of the communication passage are substantially in the same plane, so that the structure of the compressor head fixing device can be relatively flat, thereby reducing the size and saving the space.

Compared to a manner in which four fasteners are arranged in a rectangular shape around the compression chamber 11 of the compressor head fixing device in the related art, a lot of material for the compressor head fixing device in this embodiment is saves and the weight thereof is significantly reduced. In addition, due to the reduced volume, the probability of defective products during casting will also decrease.

At the same time, due to the integration of the communication passage and the assembly hole 12, a path distance of the gas from the compression chamber 11 to the noise reduction chamber 70 is significantly shortened, which reduces the exhaust resistance, and enables the compressor to start smoothly even under a low-pressure condition and to exhaust the gas to a downstream device. The technical solution in this embodiment can solve the problems of large size, large weight, large exhaust resistance, and weak capacity of low-pressure startup of the compressor in the prior art.

Figure 2:
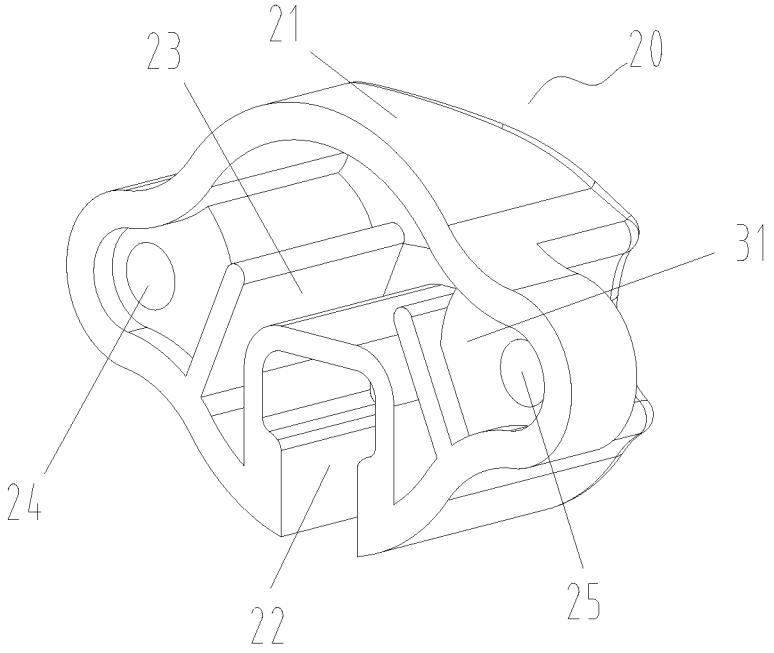
FIG. 2 is a schematic structure diagram of a cylinder head cover of a compressor head fixing device according to some embodiments of the present disclosure.

As shown in FIGS. 1 and 2, the communication passage in this embodiment includes a first communication section 31, a second communication section 32, and a third communication section. The gas flows out of the compression chamber 11 and flows to the noise reduction chamber 70 in a direction indicated by the arrow shown in FIG. 1. The cylinder head cover 20 includes a head body 21, a matching notch 22, a guide rib 23, an assembly hole 24 and an assembly hole 25. Two fasteners 40 respectively pass through the assembly hole 24 and the assembly hole 25 to connect the cylinder head cover 20 and the cylinder block 10 and implement the fixation. The matching notch 22 corresponds to the compression chamber 11; and the first communication section 31 is formed between the guide rib 23 and the head body 21. The first communication section 31 is provided in the cylinder head cover 20 and is in communication with a chamber port of the compression chamber 11 and an inlet of the assembly hole 12; the second communication section 32 is provided in the cylinder block 10 and is in communication with the assembly hole 12 and the noise reduction chamber 70; the third communication section is provided in the assembly hole 12 and is in communication with the first communication section 31 and the second communication section 32.

Specifically, as shown in FIG. 1, the assembly hole 12 in this embodiment includes a fixing portion 122 and a communication portion 121. The fixing portion 122 cooperates with the fastener 40 to connect the cylinder head cover 20 to the cylinder block 10. A gap is formed between the communication portion 121 and the fastener 40 as the third communication section. In the compressor head fixing device in this embodiment, the space between a middle part of the fastener and the assembly hole is full utilized to communicate with the first communication section 31 and the second communication section 32, to implement the communication between the compression chamber and the noise reduction chamber.

Further, the fastener 40 in this embodiment includes a bolt (or may use a screw); and a screw rod of the bolt is provided with an external thread. The fixing portion 122 includes an internal thread matching the external thread. The communication portion 121 includes an unthreaded hole; a diameter of the unthreaded hole is greater than an outer diameter of the external thread, so that the assembly hole 12 forms a stepped hole. The third communication section is an annular gap between the unthreaded hole and the bolt. In other embodiments not shown in the figures, the diameter of the unthreaded hole can also be equivalent to or slightly greater than the outer diameter of the external thread to form a spiral gap. In a position of the screw corresponding to the unthreaded hole can also be a polished rod to form an annular gap, or other forms in the assembly hole to connect the first communication section and the second communication section.

Figure 3:
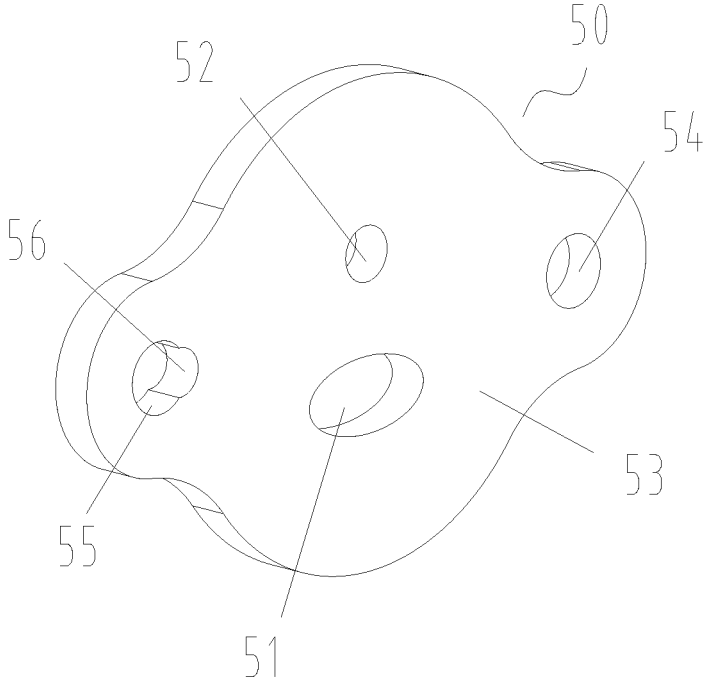
FIG. 3 is a schematic structure diagram of a valve plate of a compressor head fixing device according to some embodiments of the present disclosure.
Figure 4:
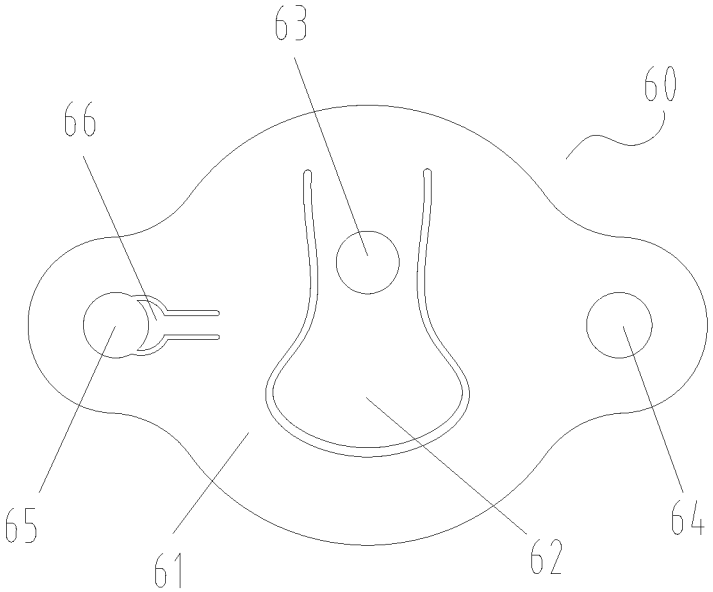
FIG. 4 is a schematic structure diagram of a valve disc of a compressor head fixing device according to some embodiments of the present disclosure.

As shown in FIGS. 3 and 4, the compressor head fixing device further includes a valve disc 60 and a valve plate 50. One of the two fasteners 40 passes through the assembly hole 24, the assembly hole 54 and the assembly hole 64, and the other passes through the assembly hole 25, the assembly hole 55, and the assembly hole 65, so that the valve disc 60 is provided between the cylinder block 10 and the cylinder head cover 20, and the valve plate 50 is provided between the valve disc 60 and the cylinder head cover 20.

The valve plate 50 includes a base body 53 and an air inlet 51 provided on the base body 53. The valve plate 60 includes a substrate 61 and a first elastic piece 62. The substrate 61 has a first through hole matching an outer contour of the first elastic piece. The first elastic piece 62 is located in the first through hole, and a root of the first elastic piece 62 is connected to a hole wall of the through hole, or the root and the hole wall are formed in one piece. The first elastic piece 62 also has a free end in the first through hole and capable of moving in a direction away from the valve plate 50 with respect to the substrate 61. An orthographic projection of the free end of the first elastic piece 62 on the valve plate 50 at least partially overlaps the air inlet 51.

When the compressor head fixing device is assembled, the compression chamber 11, the first elastic piece 62, the air inlet 51 and the matching notch 22 correspond to each other. When the compression chamber 11 inhales, the first elastic piece 62 moves to a side away from the air inlet 51 under the action of the air pressure, so that in some embodiment, the gas from the matching notch 22 side enters the compression chamber 11 through the gap formed after the movements of the air inlet 51 and the first elastic piece 62. On the one hand, the first elastic piece 62 as a one-way valve prevents the gas from exiting the compression chamber 11 from the air inlet 51. On the other hand, during the intake process, the gas pushes the first elastic piece 62 away to perform work, which consumes part of energy and can function to reduce the noise.

As shown in FIGS. 3 and 4, the valve disc 60 is further provided with a first exhaust port 63, and the valve plate 50 is further provided with a second exhaust port 52. The first exhaust port 63 is located at a position on the first elastic piece 62 adjacent to the root of the first elastic piece 62; and an orthographic projection of the first exhaust port 63 on the valve plate 50 at least partially overlaps the second exhaust port 52. When the compression chamber 11 is exhausted, the gas sequentially flows through the first exhaust port 63 and the second exhaust port 52 to the first communication section 31.

As shown in FIGS. 3 and 4, the valve plate 60 further includes a second through hole and a second elastic piece 66; the valve plate 50 further includes a third through hole and an avoidance portion 56 penetrating in a direction perpendicular to the valve plate. The fastener passes through the second through hole and the third through hole to connect to the cylinder block. The hole wall of the second through hole includes a free end of the second elastic piece 66; the avoidance portion 56 is in communication with the third through hole in a radial direction; and the second elastic piece 66 moves away from the avoidance portion 56, so that the first communication section is in communication with the third communication section pass via the avoidance part 56. With the same function as the first elastic piece 62, the second elastic piece 66 also functions to limit the flow direction and energy consumption of the gas, thereby further reducing the noise of the compressor.

In the normal exhaust process of the compressor, the exhaust is performed through the communication portion on the cylinder block, and meanwhile the exhaust pressure acts on the second elastic piece through the avoidance portion 56. The second elastic piece 66 cooperates with the communication portion on the cylinder block and opens to a side of the communication portion when the exhaust resistance is too large, to reduce the exhaust resistance and meanwhile reduce an exhaust pulsation and the exhaust noise, and improve the starting capacity of the compressor. In some embodiments, the second elastic piece 66 is a semicircular or circular reed valve disc, or an annular valve disc. The shape of the avoidance portion is circle, semicircle, square or ellipse, etc.

As shown in FIG. 1, the cylinder block 10 includes two assembly holes 12. One of the two assembly holes 12 is in communication with the noise reduction chamber 70 through the second communication section, and the other is an internally closed blind hole (that is, an inner wall of the blind hole is not is communication with the outside of the blind hole except for an orifice of the blind hole). The blind hole is in communication with a chamber opening of the compression chamber 11 through the first communication section to serve as a resonant chamber in which the sound energy is consumed by air resonance to achieve the effect of noise reduction. The two assembly holes 12 here are both stepped holes, and each includes a fixing portion 122 with an internal thread and a communication portion 121 with a diameter greater than a diameter of the fixing portion 122. Between the communication portion 121 and the fastener 40 is a gap. The gap between the communication portion 121 and the fastener 40, and the noise reduction chamber 70 respectively form a first silencing chamber and a second silencing chamber, in which the communication portion 121 is in the assembly hole 12 which is in communication with the noise reduction chamber. The first silencing chamber and the second silencing chamber are connected in series to form a multi-stage silencing chamber; and the resonant chamber can cooperate with the multi-stage silencing chamber to reduce the noise of the compressor.

In some embodiment, the outlet of the noise reduction chamber 70 is connected to a downstream device, so that the noise reduction chamber 70 also serves as a part of the exhaust passage to allow the gas to enter the downstream device through the noise reduction chamber. The silencing chamber and the resonant chamber can reduce the noise in different frequency bands.

Figure 5:
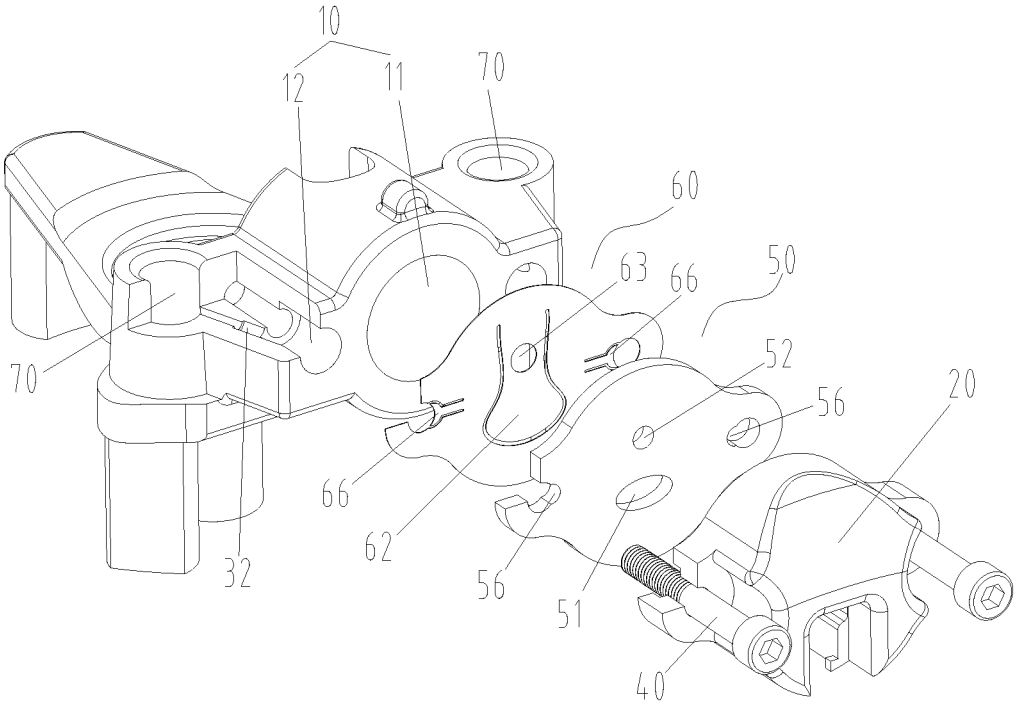
FIG. 5 is a schematic diagram illustrating a decomposed structure of a compressor head fixing device according to some embodiments of the present disclosure.

As shown in FIG. 5, the cylinder block 10 in the compressor head fixing device in an embodiment II includes two assembly holes 12 and two noise reduction chambers 70; and the two assembly holes 12 are respectively in communication with the two noise reduction chambers 70 through the second communication section. The two assembly holes 12 are both stepped holes, and each includes a fixing portion 122 with an internal thread and a communication portion 121 with a diameter greater than a diameter of the fixing portion 122. Between the communication portion 121 and the fastener 40 is a gap. The gap between the communication portion 121 in the two assembly holes 12 and the fastener 40, and the noise reduction chamber 70 can respectively form a first silencing chamber and a second silencing chamber. In such a way, the cylinder block has a pair of exhaust passages capable of silencing, thereby implementing a better effect of noise reduction.

In the above embodiment, by providing assembly holes on the left and right sides of the noise reduction chamber, the cylinder head cover interface of the cylinder block can be made into a shuttle shape, and accordingly the valve disc, valve plate and cylinder head cover can also be made into a shuttle shape. The shuttle shape is a shape which gradually transitions from the smaller ends to the larger middle portion. Here, both ends of the shuttle shape respectively correspond to two assembly holes, and the middle portion corresponds to the compression chamber. In such a way, the cost of the whole machine can be reduced. The structures of the valve disc, the valve plate and the cylinder head cover can be arranged symmetrically, for example, can be arranged symmetrically with respect to a first plane mirror passing through the axis of the compression chamber, in which the first plane is perpendicular to a second plane where axes of the two assembly holes are located.

The present disclosure further provides a compressor, which according to an embodiment (not shown in the figures) of the present disclosure includes a compressor head fixing device including the head fixing device with full or partial technical structure in the above embodiment. The compressor in the present disclosure has advantages of a compact structure, a light weight, and an adaptability to start up under low pressure conditions.

The present disclosure further provides a refrigeration device, which according to an embodiment (not shown in the figures) of the present disclosure includes a compressor with full or partial technical structure in the above-mentioned various embodiments. The refrigeration device in the present disclosure has advantages of a compact structure, a light weight, and an adaptability to start up under low pressure conditions.

From the above description, it can be seen that the above-mentioned embodiments of the present disclosure achieve the following technical effects.

The noise reduction chamber is provided on the cylinder block, and the communication passage is provided in the cylinder block and the cylinder head cover to guide the compressed gas into the noise reduction chamber to achieve noise reduction. The communication passage connecting the noise reduction chamber and the compression chamber is integrated with the assembly hole of the fixing fastener, so that the compressor head fixing device has a compact structure, which provides the possibility of reducing the volume of the compressor head fixing device, shortening the length of the exhaust passage, and reducing the exhaust pressure.

So far, various embodiments of the present disclosure have been described in detail. In order to avoid obscuring the concept of the present disclosure, some details known in the art are not described. Based on the above description, those skilled in the art can fully understand how to implement the technical solutions disclosed herein.

Although some specific embodiments of the present disclosure have been described in detail through examples, those skilled in the art should understand that the above examples are only for illustration and not for limiting the scope of the present disclosure. Those skilled in the art should understand that, the above embodiments can be modified or some technical features can be equivalently replaced without departing from the scope and spirit of the present disclosure. The scope of the present disclosure is subject to the appended claims.

What is claimed is:

1. A compressor head fixing device, comprising:

a cylinder block and a cylinder head cover, the cylinder head cover being connected to the cylinder block by a fastener, the cylinder block being provided with a compression chamber and an assembly hole configured to fix the fastener;

a noise reduction chamber, provided on the cylinder block; and a communication passage, provided in the cylinder block and the cylinder head cover, and being in communication with the assembly hole, the noise reduction chamber and the compression chamber;

wherein the communication passage comprises:

a first communication section, provided in the cylinder head cover and being in communication with a chamber opening of the compression chamber and an inlet of the assembly hole;

a second communication section, provided in the cylinder block and being in communication with the assembly hole and the noise reduction chamber; and a third communication section, provided in the assembly hole and being in communication with the first communication section and the second communication section;

the compressor head fixing device further comprises a valve disc and a valve plate, the valve disc is provided between the cylinder block and the cylinder head cover, the valve plate is provided between the valve disc and the cylinder head cover, the valve plate is provided with an air inlet, the valve disc comprises a substrate and a first elastic piece, the substrate is provided with a first through hole matching an outer contour of the first elastic piece, the first elastic piece is located in the first through hole, a root of the first elastic piece is connected to a hole wall of the through hole or the root and the hole wall are formed in one piece, the first elastic piece is further provided with a free end which is in the first through hole and is capable of moving away from the valve plate with respect to the substrate, an orthographic projection of the free end of the first elastic piece on the valve plate at least partially overlaps the air inlet;

the valve disc further comprises: a second through hole and a second elastic piece, the valve plate further comprises: a third through hole and an avoidance portion penetrating in a direction perpendicular to the valve plate, the fastener passes through the second through hole and the third through hole to connect to the cylinder block, a hole wall of the second through hole comprises a free end of the second elastic piece, the avoidance portion is in communication with the third through hole in a radial direction, the second elastic piece is capable of moving away from the avoidance portion to make the first communication section be in communication with the third communication section via the avoidance portion.

2. The compressor head fixing device according to claim 1, wherein the assembly hole comprises a fixing portion and a communication portion, the fixing portion cooperates with the fastener to connect the cylinder head cover to the cylinder block, and a gap as the third communication section is formed between the communication portion and the fastener.

3. The compressor head fixing device according to claim 2, wherein the fastener comprises a bolt, a screw rod of the bolt is provided with an external thread, the fixing portion comprises an internal thread matching the external thread, the communication portion comprises an unthreaded hole, and a radial gap between the unthreaded hole and the screw rod of the bolt forms the third communication section.

4. The compressor head fixing device according to claim 1, wherein the valve disc is provided with a first exhaust port, the valve plate is provided with a second exhaust port, the second exhaust port is in communication with the compression chamber through the first exhaust port.

5. The compressor head fixing device according to claim 4, wherein the first exhaust port is located at a position on the first elastic piece adjacent to the root of the first elastic piece, an orthographic projection of the first exhaust port on the valve plate at least partially overlaps the second exhaust port.

6. The compressor head fixing device according to claim 1, wherein the cylinder block comprises two assembly holes, one of the two assembly holes is in communication with the noise reduction chamber through the second communication section, the other is an internally closed blind hole, the blind hole is in communication with the chamber opening of the compression chamber through the first communication section to serve as a resonant chamber.

7. The compressor head fixing device according to claim 6, wherein each assembly hole is a stepped hole and comprises a fixing portion with an internal thread and a communication portion with a diameter greater than a diameter of the fixing portion, a gap is provided between the communication portion and the fastener; the gap between the communication portion and the fastener, and the noise reduction chamber respectively form a first silencing chamber and a second silencing chamber, wherein the communication portion is in the assembly hole which is in communication with the noise reduction chamber.

8. The compressor head fixing device according to claim 1, wherein the cylinder block comprises two assembly holes and two noise reduction chambers, the two assembly holes are respectively in communication with the two noise reduction chambers through the second communication section.

9. The compressor head fixing device according to claim 8, wherein each assembly hole is a stepped hole and comprises a fixing portion with an internal thread and a communication portion with a diameter greater than a diameter of the fixing portion, a gap is provided between the communication portion and the fastener; the gap between the communication portion and the fastener, and the noise reduction chamber respectively form a first silencing chamber and a second silencing chamber, wherein the communication portion is in the assembly hole which is in communication with the noise reduction chamber.

10. The compressor head fixing device according to claim 1, wherein an axis of the compression chamber, an axis of the assembly hole and an axis of the communication passage are coplanar.

11. A compressor, comprising a compressor head fixing device, wherein the head fixing device refers to the compressor head fixing device of claim 1.

12. A refrigeration device, comprising the compressor of claim 11.

* * * * *